United States Patent [19]

Serr et al.

[11] 3,987,927

[45] Oct. 26, 1976

[54] BEAD JOINT

[75] Inventors: Georg Serr, Neustadt, Weinstrasse; Franz Gobauer, Hambach, both of Germany

[73] Assignee: Rheinpfalzische Blechemballagenfabrik G. Schonung & Co. KG, Neustadt, Germany

[22] Filed: June 24, 1974

[21] Appl. No.: 482,412

Related U.S. Application Data

[63] Continuation of Ser. No. 265,755, June 23, 1972, abandoned.

[30] Foreign Application Priority Data

July 8, 1971 Germany ..... 2134034

[52] U.S. Cl. ..... 220/67; 220/74; 220/81 R

[51] Int. Cl.[2] ..... B65D 7/44

[58] Field of Search ..... 220/67, 75, 66, 68, 220/73, 77, 78, 79, 81 R; 229/5.6, 5.5

[56] References Cited

UNITED STATES PATENTS

| | | | |
|---|---|---|---|
| 670,720 | 3/1901 | Mungiven | 220/77 |
| 1,478,782 | 12/1923 | Dewey et al. | 220/81 R |
| 1,590,753 | 6/1926 | Hulbert | 229/5.6 |
| 1,662,277 | 3/1928 | Moore | 229/5.6 |
| 2,169,395 | 8/1939 | Rheen | 220/66 |
| 3,169,678 | 2/1965 | Wilkinson | 222/478 |

FOREIGN PATENTS OR APPLICATIONS

| | | |
|---|---|---|
| 1,447,436 | 6/1966 | France |
| 6,406,427 | 10/1965 | Netherlands |
| 20,662 | 9/1914 | United Kingdom |

*Primary Examiner*—William Price
*Assistant Examiner*—Joseph M. Moy

[57] ABSTRACT

A bead joint between plastically deformable edges of a container side wall and an end wall for the container wherein the edges are adjacent each other and are folded over several times to form a plurality of folds for the joint, a sealing compound being within the joint. The joint is generally elliptical, with the folds having different radii and the radium of transition between the edges and a first fold of the bead joint being relatively small and gradually increasing.

1 Claim, 3 Drawing Figures

BEAD JOINT

This is a continuation of application Ser. No. 265,755, filed June 23, 1972 and now abandoned.

The present invention relates to improvements in a bead joint between plastically deformable edges of a container side wall and an end wall (bottom or top) for the container. The edges are conformingly adjacent each other and are folded over several times to form a plurality of folds for the joint, and a sealing means is within the joint.

The container side wall may be cylindrical, for instance, and the side and end walls may consist of a deformable sheet metal.

Bead joints have been proposed wherein the edges are folded over to form three folds, for instance, the outer fold of the end wall edge being bent over at least 540° while the inner fold of the side wall is bent over about 360°, the folds forming a spiral which is then flattened. Other formations have also been proposed in such joints, and it has also been suggested to place a sealing compound within the joints.

All the known joints of this general type have the disadvantage that the bead folds tend to unravel or to be loosened under internal pressure from the container or when the container is dropped so that the joint becomes leaky.

It is the primary object of this invention to overcome this disadvantage and to improve the stability of the joint under various conditions of use.

The above and other objects are accomplished in accordance with the invention with a bead joint which is generally elliptical and wherein the folds have unequal radii. The radius of transition between the edges and a first bead joint fold is relatively small and increases gradually.

The type of bead joint has the considerable advantage that it imparts considerable stability against outward bulging of the end wall, the small folding radius at the transition between the end and side wall edges to the first fold of the joint providing particularly high resistance against the pressures in this direction. The small bending radius in the transition zone imparts added stiffness to the material in this zone.

Figure 1:
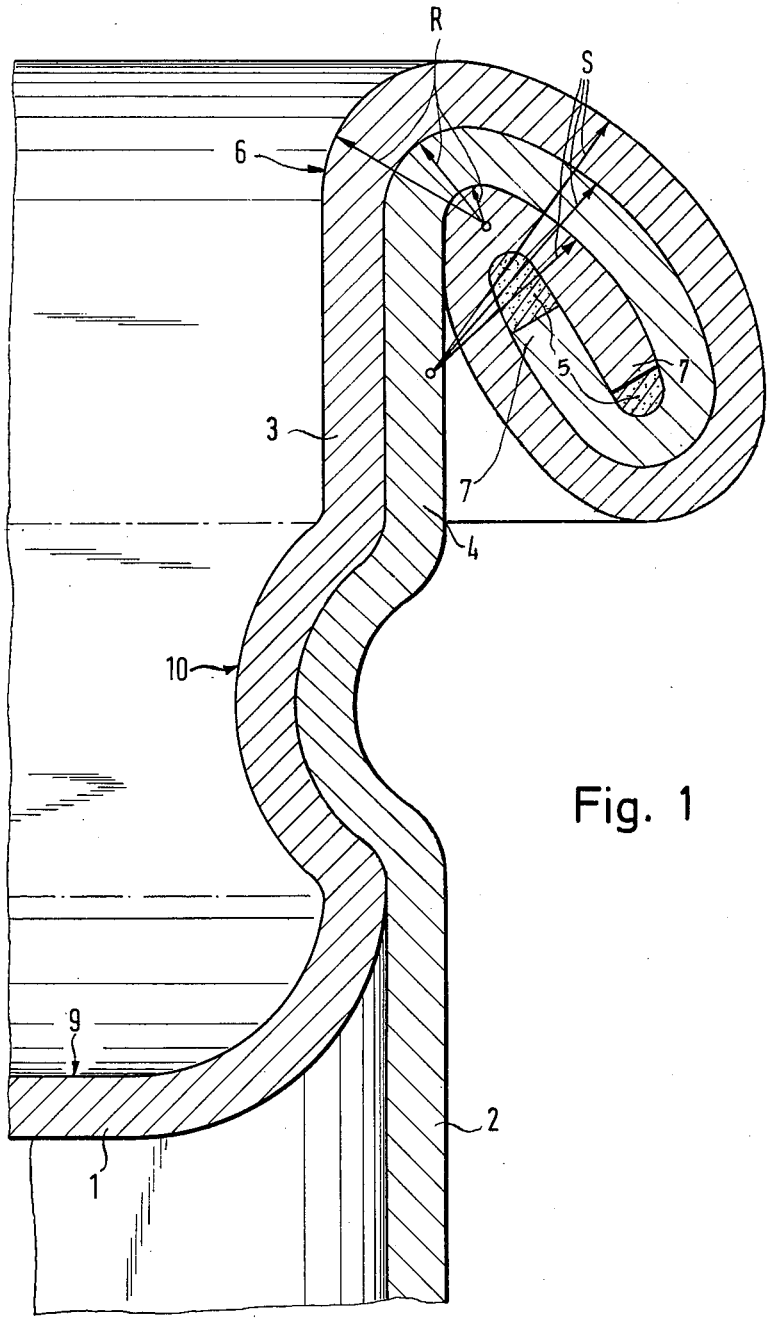
Figure 2:
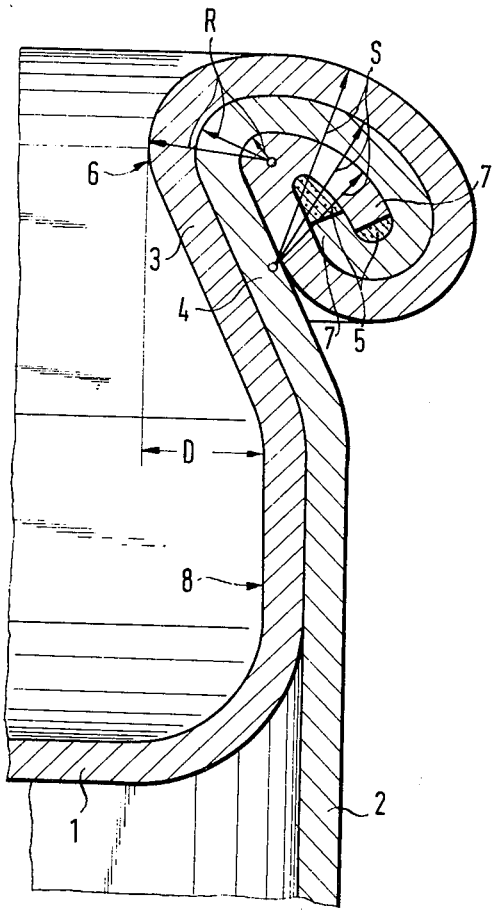
Figure 3:
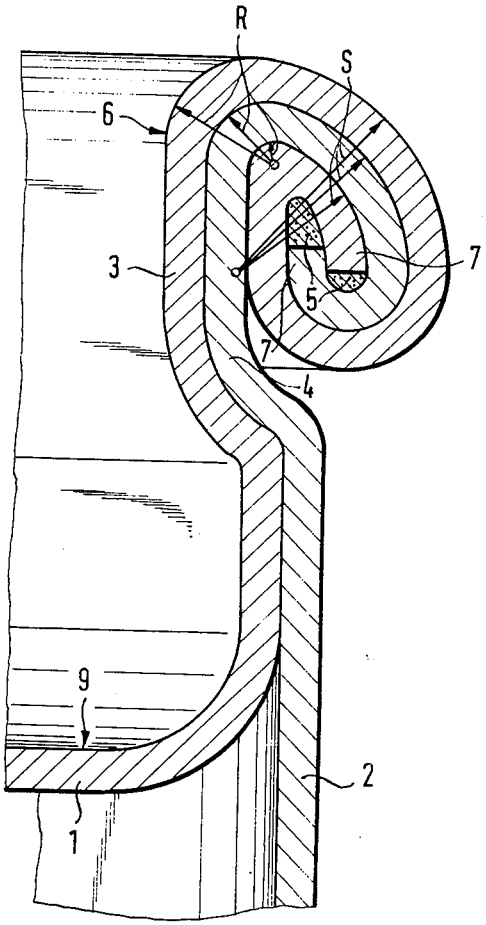

The above and other objects, advantages and features of the present invention will become more apparent in the following description of certain presently preferred embodiments thereof, taken in conjunction with the accompanying drawing wherein FIG. 1 is a vertical cross section of one embodiment of the bead joint of this invention; and FIGS. 2 and 3 are like views of two modifications of this embodiment.

Referring now to the drawing, wherein like reference numerals designate like parts functioning in a like manner in all figures to avoid prolixity in the description, FIG. 1 shows an end wall 1, which may be the top and/or bottom of the container, while 2 designates the container side wall. The end wall edge 3 and the side wall edge 4 are conformingly adjacent each other and are plastically deformable. They are folded over three times to form three folds for the illustrated joint. Obviously, the joint may have four or more folds, if desired. The folds are rolled into a spiral formation, with the outer end wall folds being bent a total of about 540° while the inner side wall folds extend over an angle of about 360°. A sealing compound 5 fills the cavities of the joint.

In accordance with the invention, instead of being circularly bent, i.e. with uniform radius, the folds have unequal radii to form a bead joint of substantially elliptical transverse cross section, the radius R of the transition between the edges and a first bead joint fold being relatively small, i.e. smaller than it would be if the first fold formed a circle, and the radius S of this fold gradually increasing. The end folds 7 of the side and end wall edges are in barblike engagement. While the folds of the side and end wall edges are illustrated as being in contact with each other, their respective radii may be so chosen that they define a gap therebetween which may be filled with a sealing compound.

As shown in FIG. 1, the end wall will be protected against pressure in the main direction for further protection of the bead joint when the edges of the container side wall and the end wall define an inwardly projecting groove 10, with the entire bead joint being positioned above this groove.

The modification of FIG. 2 is substantially identical with the embodiment of FIG. 1, except that the edges of the container side wall and of the end wall are inwardly bent by a distance D to form a frusto-conical end portion, with the entire bead joint being positioned at this inwardly bent portion. This again improves the stability of the joint against internal pressures from the container and also helps to prevent outward bulging of the end wall under such pressure.

Substantially the same result is obtained with the modification of FIG. 3 wherein the edges are inwardly bent to form a shoulder and a portion parallel to the side wall adjacent to which the bead joint is positioned.

What is claimed is:

1. In a bead joint disposed outwardly along the rolled top edge portion of a container side wall and end wall, the side and end wall edges being conformingly adjacent each other and folded over several times to form a plurality of folds forming the joint, and a sealing means within the joint, the improvements of the folds having unequal bending radii to impart to the bead joint a generally elliptical or egg-shaped cross section, the major axis of the bead joint cross section being inclined towards the axis of the container, the bending radius of transition of the container and a first one of the bead joint folds being relatively small whereby the first bead joint fold encloses an angle of less than 90° with the side wall to provide a zone of added stiffness, the bending radius then gradually increasing to form an arcuate portion of the bead joint cross section and the bending radius then further varying to complete the bead joint with at least two further folds, and the folded-over side and end wall edges being in contact with each other within the joint.

* * * * *